US006343467B1

(12) United States Patent
Muto et al.

(10) Patent No.: US 6,343,467 B1
(45) **Date of Patent: *Feb. 5, 2002**

(54) AIR-FUEL RATIO CONTROL APPARATUS AND METHOD FOR INTERNAL COMBUSTION ENGINE

(75) Inventors: Hidenobu Muto, Obu; Hisashi Iida; Shujiro Morinaga, both of Kariya, all of (JP)

(73) Assignee: Denso Corporation, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/119,604

(22) Filed: Jul. 22, 1998

(30) Foreign Application Priority Data

Jul. 28, 1997 (JP) ..... 9-201141

(51) Int. Cl.[7] ..... F01N 3/00

(52) U.S. Cl. ..... 60/285; 60/274; 60/283; 123/698; 123/518; 123/519; 123/520

(58) Field of Search ..... 60/274, 285, 286, 60/283; 123/698, 520, 518, 519

(56) References Cited

U.S. PATENT DOCUMENTS 5,239,824 A * 8/1993 Matsumoto ..... 60/283
5,245,975 A * 9/1993 Ito ..... 123/520
5,305,724 A * 4/1994 Chikamatsu et al. ..... 123/520
5,426,938 A * 6/1995 Ogawa et al. ..... 60/285
5,445,133 A * 8/1995 Nemoto ..... 123/520
5,507,269 A * 4/1996 Morikawa ..... 123/684
5,680,756 A * 10/1997 Harima ..... 60/274
5,699,778 A * 12/1997 Muraguchi et al. ..... 123/698
5,724,952 A * 3/1998 Miyashita et al. ..... 123/688
5,862,795 A * 1/1999 Osanai ..... 123/520
5,921,226 A * 7/1999 Toyohara et al. ..... 123/674
5,979,160 A * 11/1999 Yashiki et al. ..... 60/276
6,145,306 A * 11/2000 Takagi et al. ..... 60/283

FOREIGN PATENT DOCUMENTS

| | | |
|---|---|---|
| JP | A 3-271541 | 3/1990 |
| JP | 05-059977 | 3/1993 |
| JP | 07-083130 | 3/1995 |
| JP | A-8-109844 | 4/1996 |

* cited by examiner

*Primary Examiner*—Thomas Denion
*Assistant Examiner*—Binh Tran
(74) *Attorney, Agent, or Firm*—Nixon & Vanderhye P.C.

(57) ABSTRACT

Evaporated fuel gas from a canister is introduced into an intake path of an internal combustion engine. A target air-fuel ratio is changed to a value on the fuel rich side during the introduction of purge gas in accordance with the purge gas concentration. This change will restrict the shift of the air-fuel ratio toward the lean side, allowing a catalyst to operate at high purification efficiency even during the introduction of purge gas. The change may be varied in accordance with the volume of the evaporated fuel gas or a ratio of the evaporated fuel gas to the fuel supplied to the engine.

15 Claims, 11 Drawing Sheets

FULL-OPEN PURGE RATE (PGRMX : %)

| Ne (rpm) \ PM (mmHg) | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

FUEL EVAPORA. GAS CONCENTRA. DETEC.

401
KEY SWITCH ON?
YES
NO
402
XPRG=1?
NO
YES
403
ACCELERATING/ DECELERATING?
YES
NO
404
XNFGPG=1?
NO
YES
405
PRG>β%?
NO
YES
406
|1-FAFAV| >ω%?
NO
YES
407
FGPG = FGPG(i-1) + (FAFAV-1)/PGR
PGPG=1.0
412
FGPGAV=1.0
413
XNFGPG=0
414
RETURN
408
XNFGPG=1?
YES
NO
409
STABILIZED?
NO
YES
XNFGPG=1
410
CALCULATE FGPGAV
411
RETURN

AIR-FUEL RATIO CONTROL APPARATUS AND METHOD FOR INTERNAL COMBUSTION ENGINE

CROSS REFERENCE TO RELATED APPLICATION

This application relates to and incorporates herein by reference Japanese Patent Application No. 9-201141 filed on Jul. 28, 1997.

BACKGROUND OF THE INVENTION

1. Field of the Invention

The present invention relates to an air-fuel ratio control apparatus and method for an internal combustion engine provided with a fuel evaporative emission purge system for introducing fuel evaporative gas adsorbed by a canister to an intake path of the internal combustion engine.

2. Description of Related Art

Fuel evaporative gas introduced or purged from a canister to an intake path of an internal combustion engine (purge gas) contains fuel. Thus, during the introduction of purge gas, the volume of fuel injected by a fuel injecting valve needs to be corrected by reduction of the fuel volume in accordance with the volume of the introduced purge gas in order to adjust the volume of the fuel supplied to the internal combustion engine to a required value. As disclosed in Japanese Patent Laid-open No. Hei 8-109844, however, some of the fuel injected from the fuel injecting valve is stuck to the internal wall of an intake pipe during the introduction of purge gas. As a result, the air-fuel ratio of air-fuel mixture is likely to deviate from a stoichiometric air-fuel ratio, or a target air-fuel ratio, to the lean side. For this reason, in the above air-fuel ratio control apparatus, an air-fuel ratio feedback correction coefficient is corrected to shift the air-fuel ratio to the rich side in dependence on deviations of the air-fuel ratio feedback correction coefficient detected before and after the introduction of purge gas. As a result, the air-fuel ratio of air-fuel mixture gas supplied to the internal combustion engine during the introduction of purge gas is converged to the stoichiometric air-fuel ratio.

In general, a three-way catalyst used for purifying NOx, CO and HC contained in exhausted gas has a narrow purifying range (window) only around the stoichiometric air-fuel ratio with a value ranging from 14.6 to 14.7 as shown in FIG. 15. It should be noted that the window implies a range of air-fuel ratios in which the purifying efficiencies of NOx, CO and HC are all high. Thus, air-fuel ratio feedback control must be carried out toward the stoichiometric air-fuel ratio used as a target air-fuel ratio even during introduction of purge gas.

According to results of a recent study, however, it has been found that the air-fuel ratio of the air-fuel mixture is shifted to the lean side from the window of the three-way catalyst even if the air-fuel ratio feedback control is carried out during introduction of purge gas. This is considered to occur as follows. As shown in Table 1 below, gasoline used as a fuel contains a number of hydrocarbon components of different types, and the stoichiometric air-fuel ratio as well as the boiling point vary from type to type. A stoichiometric air-fuel ratio in the range 14.6 to 14.7 of the fuel as a whole is actually an average value of the stoichiometric air-fuel ratios of these components.

TABLE 1

| Main hydrocarbons contained In gasoline | | Stoichiometric air-fuel ratio | Boiling point (° C.) |
|---|---|---|---|
| Paraffin group | Methane (C1) $CH_4$ | 17.24 | −164 |
| | Ethane (C2) $C_2H_6$ | 16.09 | −88 |
| | Propane (C3) $C_3H_8$ | 15.67 | −45 |
| | Butane (C4) $C_4H_{10}$ | 15.46 | 1 |
| | Pentane (C5) $C_5H_{12}$ | 15.36 | 36 |
| | Hexane (C6) $C_6H_{14}$ | 15.27 | 69 |
| | Heptane (C7) $C_7H_{16}$ | 15.2 | 98 |
| | Octane (C8) $C_8H_{18}$ | 15.14 | 124 |
| Aromatic | Benzene (C6) $C_6H_6$ | 13.2 | 80 |
| | Toluene (C7) $C_7H_8$ | 13.4 | 110 |
| | Xylene (C8) $C_8H_{10}$ | 13.6 | 140 |

C1 to C8: Carbon numbers (Cn)

Since purge gas introduced into the internal combustion engine is fuel evaporative gas evaporated from gasoline in a fuel tank, a number of hydrocarbon components each with a low boiling point are contained in the purge gas. As shown in Table 1, the smaller the carbon number (Cn), the lower the boiling point of the hydrocarbon. Thus, the purge gas contains a number of hydrocarbon components each with a low carbon number such as methane, ethane, propane, butane and pentane with carbon numbers C1, C2, C3, C4 and C5 respectively as shown in FIG. 16. The stoichiometric air-fuel ratios of these hydrocarbon components are in the range 17.24 to 15.36 which is higher than the range 14.6 to 14.7 of the stoichiometric air-fuel ratio of the fuel as a whole. Thus, during the introduction of purge gas, the stoichiometric air-fuel ratio of the fuel as a whole supplied to the internal combustion engine becomes higher than the stoichiometric air-fuel ratio of ordinary fuel which is in the range 14.6 to 14.7.

For the above reason, during the introduction of purge gas, if air-fuel ratio feedback control is carried out by using the normal stoichiometric air-fuel ratio which is in the range 14.6 to 14.7 as a target air-fuel ratio, the air-fuel ratio of the air-fuel mixture during the introduction of purge gas is shifted from the window of the three-way catalyst to the lean side, decreasing the efficiency of purifying of NOx.

SUMMARY OF THE INVENTION

It is thus an object of the present invention to provide an air-fuel ratio control apparatus and method for an internal combustion engine that is capable of optimizing air-fuel ratio feedback control during introduction of purge gas and increasing the efficiency of purifying of gas exhausted during the introduction of purge gas.

According the present invention, target air-fuel ratio is corrected or changed to a value on a fuel-rich side during introduction of purge gas due to the fact that the air-fuel ratio of the air-fuel mixture during the introduction of purge gas (fuel evaporative gas) is shifted from a window of a three-way catalyst to a fuel-lean side. As a result, since the air-fuel mixture ratio is subjected to feedback control toward the corrected target rich side air-fuel ratio during the introduction of purge gas, the shift of the air-fuel ratio of the air-fuel mixture to the lean side caused by the introduction of purge gas can be canceled by the correction of the target air-fuel ratio to the value on the rich side. The air-fuel ratio of the air-fuel mixture during the introduction of purge gas can thus be controlled to a value within the range of the window of the three-way catalyst, making it possible to increase the efficiency of purifying of the gas exhausted during the introduction of purge gas.

Preferably, the amount of correction of the target air-fuel ratio to a value on the rich side can be set in accordance with the volume of introduced purge gas. As the ratio of purge gas to fuel supplied to the internal combustion engine, that is, the concentration of the purge gas, rises accompanying an increase in volume of the introduced purge gas, the shift of the stoichiometric air-fuel ratio of the supplied fuel as a whole to the lean side also increases. Thus, by setting the amount of correction of the target air-fuel ratio to a value on the rich side in accordance with the volume of the introduced purge gas, the setting of the target air-fuel ratio during the introduction of purge gas can be further optimized. It should be noted that one of parameters such as the weight of the purge gas, the concentration of the purge gas, the flow rate of the purge gas and the control duty of a purge control valve employed in a fuel evaporative emission purge system can be appropriately selected to represent the volume of the introduced purge gas.

In addition, taking the differences in stoichiometric air-fuel ratio among gas components shown in Table 1 given above into consideration, the amount of correction of the target air-fuel ratio to a value on the rich side can be set in accordance with the volume of introduced purge gas and components of the purge gas. Thus, the amount of correction of the target air-fuel ratio to a value on the rich side during introduction of purge gas can be set with a higher degree of accuracy.

BRIEF DESCRIPTION OF THE DRAWINGS

Other objects, features and advantages of the present invention will become more apparent from the following detailed description made with reference to the accompanying drawings.

DETAILED DESCRIPTION OF THE PREFERRED EMBODIMENT

Figure 1:
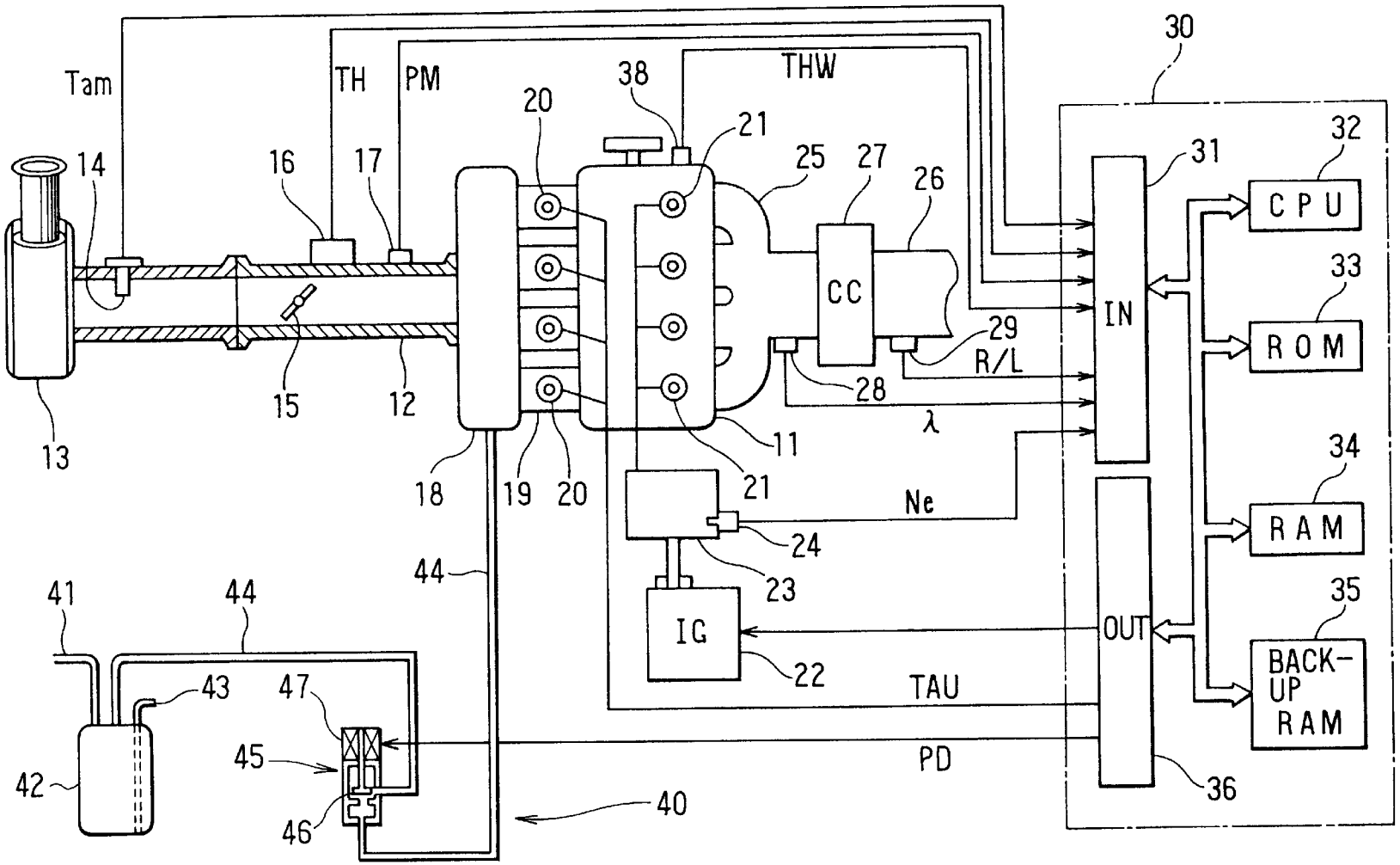
FIG. 1 is a schematic diagram showing the overall configuration of an engine control system as implemented by an embodiment of the present invention.

As shown in the figure, an air cleaner 13 is installed on the upstream end portion of an intake pipe 12 (intake path) of an internal combustion engine 11. On the downstream side of the air cleaner 13, there is installed an intake air temperature sensor 14 for sensing the temperature Tam of intake air. On the downstream side of the intake air temperature sensor 14, there are installed a throttle valve 15 and a throttle opening sensor 16 for sensing the throttle opening TH of the throttle valve 15.

On the downstream side of the throttle valve 15, there is further provided an intake air pressure sensor 17 for sensing the intake air pressure PM. On the downstream side of the intake air pressure sensor 17, a surge tank 18 (intake path) is installed. The surge tank 18 is connected each intake manifold 19 (intake path) for introducing air to cylinders of the internal combustion engine 11. On the branch pipe portion of each of the cylinders on the manifold 19, a fuel injecting valve 20 for injecting fuel into the cylinder is provided.

For each of the cylinders, an ignition plug 21 is provided on the internal combustion engine 11. A high voltage current generated by an ignition circuit 22 is supplied to each of the ignition plugs 21 through a distributor 23. On the distributor 23, there is installed a crank angle sensor 24 for outputting typically 24 pulse signals per 720° C. A or 2 rotations of the crankshaft. The engine revolution speed Ne is calculated from the time interval between consecutive pulses output by the crank angle sensor 24. Also installed on the internal combustion engine 11 is a coolant temperature sensor 38 for sensing the temperature THW of engine coolant.

Each exhaust port (not shown) of the internal combustion engine 11 is connected to an exhaust pipe 26 through an exhaust manifold 25. At a position on the exhaust pipe 26, there is provided a three-way catalyst (CC) 27 for reducing the amount of hazardous components such as CO, HC and NOx contained in exhausted gas. On the upstream side of the three-way catalyst 27, there is provided an air-fuel ratio sensor 28 for outputting a linear air-fuel ratio signal λ representing the air-fuel ratio of the air-fuel mixture. The air-fuel ratio of air-fuel mixture supplied to the internal combustion engine 11 can be detected from the oxygen concentration in the exhaust gas. On the downstream side of the three-way catalyst 27, on the other hand, there is installed an oxygen sensor 29 for outputting a voltage R/L which changes between one logic value (fuel rich side) and the other logic level (fuel lean side) with respect to the stoichiometric ratio (concentration of 0% of oxygen contained in the exhausted gas).

In a fuel evaporative emission purge system 40, a canister 42 is connected to a fuel tank (not shown) through a communicating tube 41. The canister 42 accommodates an adsorption material such as activated carbon for adsorbing fuel evaporative gas. In addition, on the canister 42, there is provided an atmosphere communicating tube 43 for communication with the atmosphere. Between the canister 42 and the surge tank 18, there is installed a purge path 44 for purging (discharging) fuel evaporative gas adsorbed into the canister 42 to the surge tank 18. At a position on the purge path 44, there is installed a purge control valve 45 for adjusting the purge flow rate.

Figure 2:
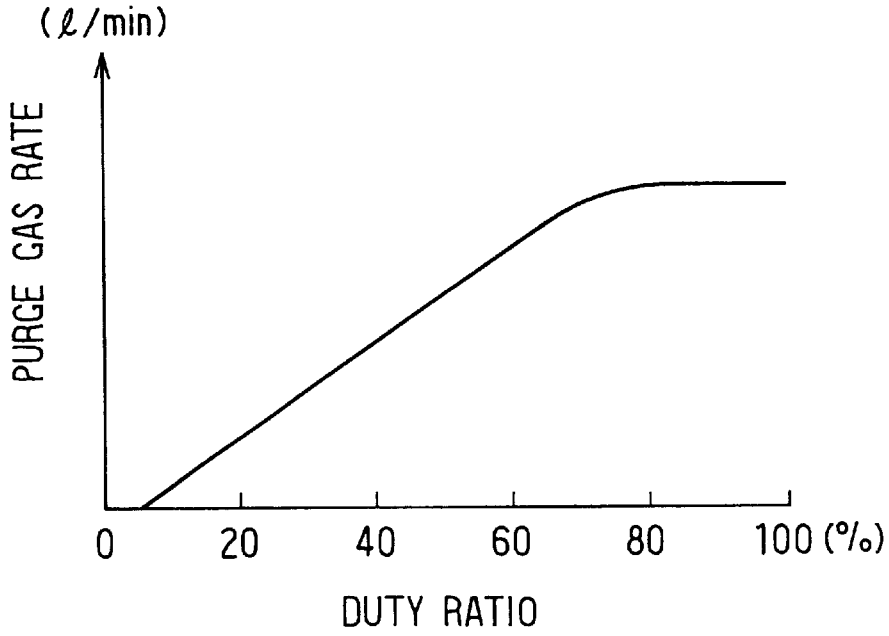
FIG. 2 is a diagram showing a characteristic representing the relation of the duty ratio of a purge control valve and the flow rate of purge gas.

The purge control valve 45 is an electromagnetic valve comprising primarily a valve body 46 for opening and closing an internal gas flow path and a solenoid coil 47 moving the valve body 46 in the valve opening direction against a spring (not shown). The voltage of a pulse signal PD is applied to the solenoid coil 47 of the purge control valve 45. By changing the duty ratio of the pulse signal PD, that is, a ratio of the pulse width to the period of the pulse signal PD, the opening of the valve body 46 can be adjusted, allowing the flow rate of purge gas introduced from the canister 42 to the surge tank 18 to be controlled. A characteristic representing the relation of the duty ratio of the purge control valve 45 and the flow rate of the purge gas is shown in FIG. 2.

The engine control system also includes an engine control unit 30 to which various kinds of information representing the operating state of the internal combustion engine 11 are supplied from a variety of sensors described above by way of an input port 31. The engine control unit 30 is implemented mainly by a microcomputer which generally comprises, a CPU 32, a ROM unit 33, a RAM unit 34 and a backup RAM unit 35 backed up by a battery (not shown). The microcomputer calculates quantities such as a fuel injection volume TAU and ignition timing IG by execution of programs stored in the ROM unit 33 and outputs signals representing results of processing to the fuel injecting valve 20 and the ignition circuit 22 by way of an output port 36 in order to control the operation of the internal combustion engine 11.

The engine control unit 30 is programmed to execute the following control programs.

[Air-fuel Ratio Control]

Figure 4:
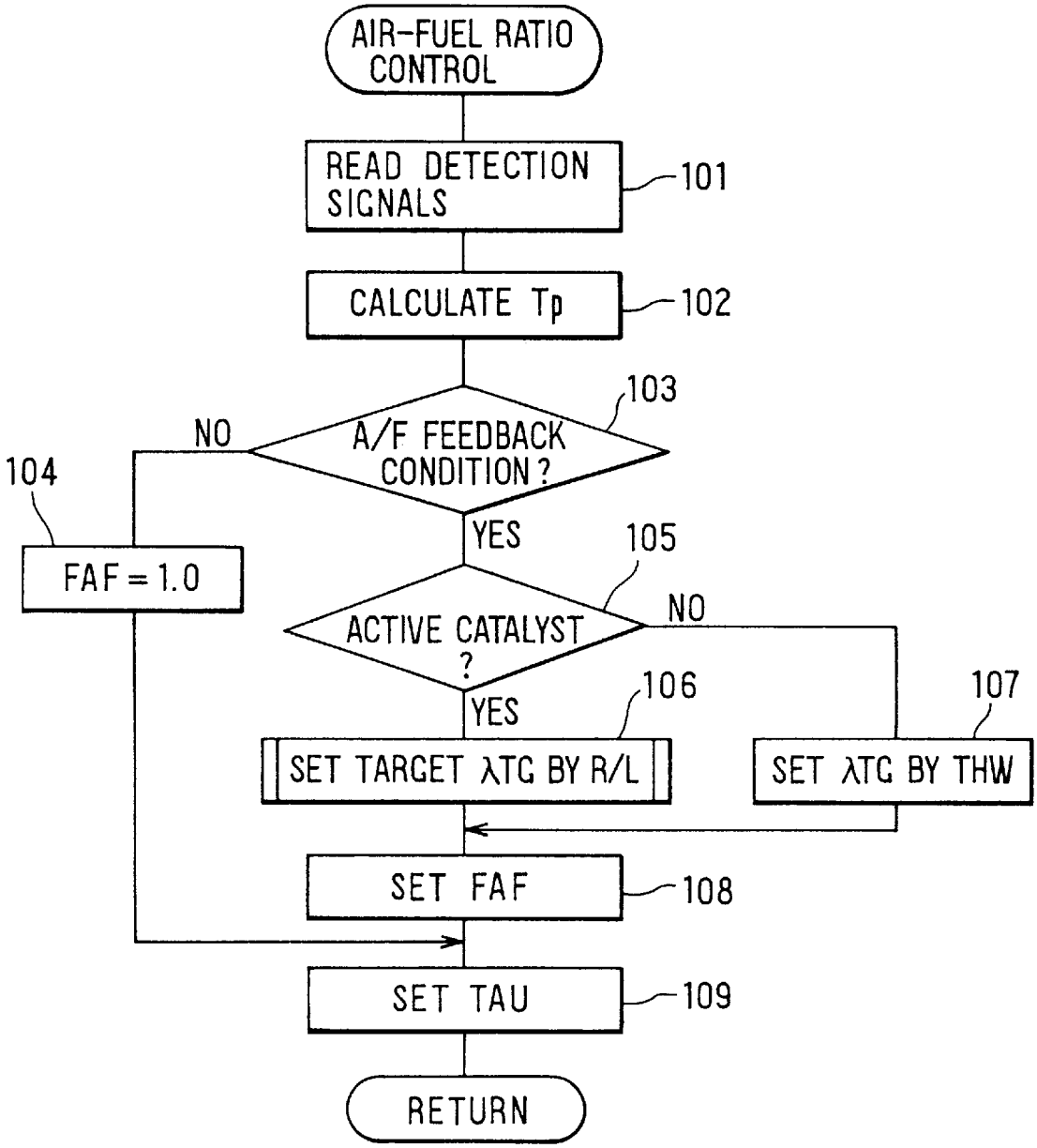
FIG. 4 is a flowchart showing a processing of an air-fuel ratio control program executed in the embodiment.

An air-fuel ratio control program shown in FIG. 4 is a program for setting a fuel injection volume TAU by execution of feedback control of the air-fuel ratio at predetermined crank angle intervals of typically 360° C.A. As shown in the figure, the processing begins with step 101 to read in detection signals representing the engine revolution speed Ne, the intake air pressure PM, the coolant temperature THW, the air-fuel ratio λ and the oxygen concentration R/L (rich/lean) in exhausted gas from a variety of sensors. The processing then goes on to step 102 at which a basic fuel injection volume Tp is calculated from the operating state of the internal combustion engine 11 represented by some of the quantities such as the engine revolution speed Ne and the intake air pressure PM by using a map or the like.

Then, the processing proceeds to step 103 to determine whether or not an air-fuel ratio feedback condition is satisfied. The air-fuel ratio feedback condition is to be satisfied if all the following conditions A1 to A4 are satisfied.

(A1) A variety of fuel increase corrections are not made.

(A2) A fuel cut is not implemented.

(A3) A heavy load operation is not under way.

(A4) The air-fuel ratio sensor 28 is activated.

It is possible to determine whether or not condition (A4) stating: "The air-fuel ratio sensor 28 is activated." for example:

<1> determining whether or not the coolant temperature is equal to or higher than a value of typically 30° C.;

<2> determining whether or not time has lapsed since the start of the engine operation by at least a predetermined period;

<3> determining whether or not the air-fuel ratio sensor 28 actually outputs a signal λ; or <4> detecting the oxygen responsive element impedance of the air-fuel ratio sensor 28 representing the element temperature thereof and determining based on the detected element impedance.

If the determination at step 103 indicates that the air-fuel ratio feedback condition is not satisfied, the processing continues to step 104 at which an air-fuel ratio feedback correction coefficient FAF corresponding to a feedback correction quantity is set at 1.0 by which no feedback correction is effected. Then, the processing goes onto step 109. In this case, the air-fuel ratio is not corrected.

Figure 10:
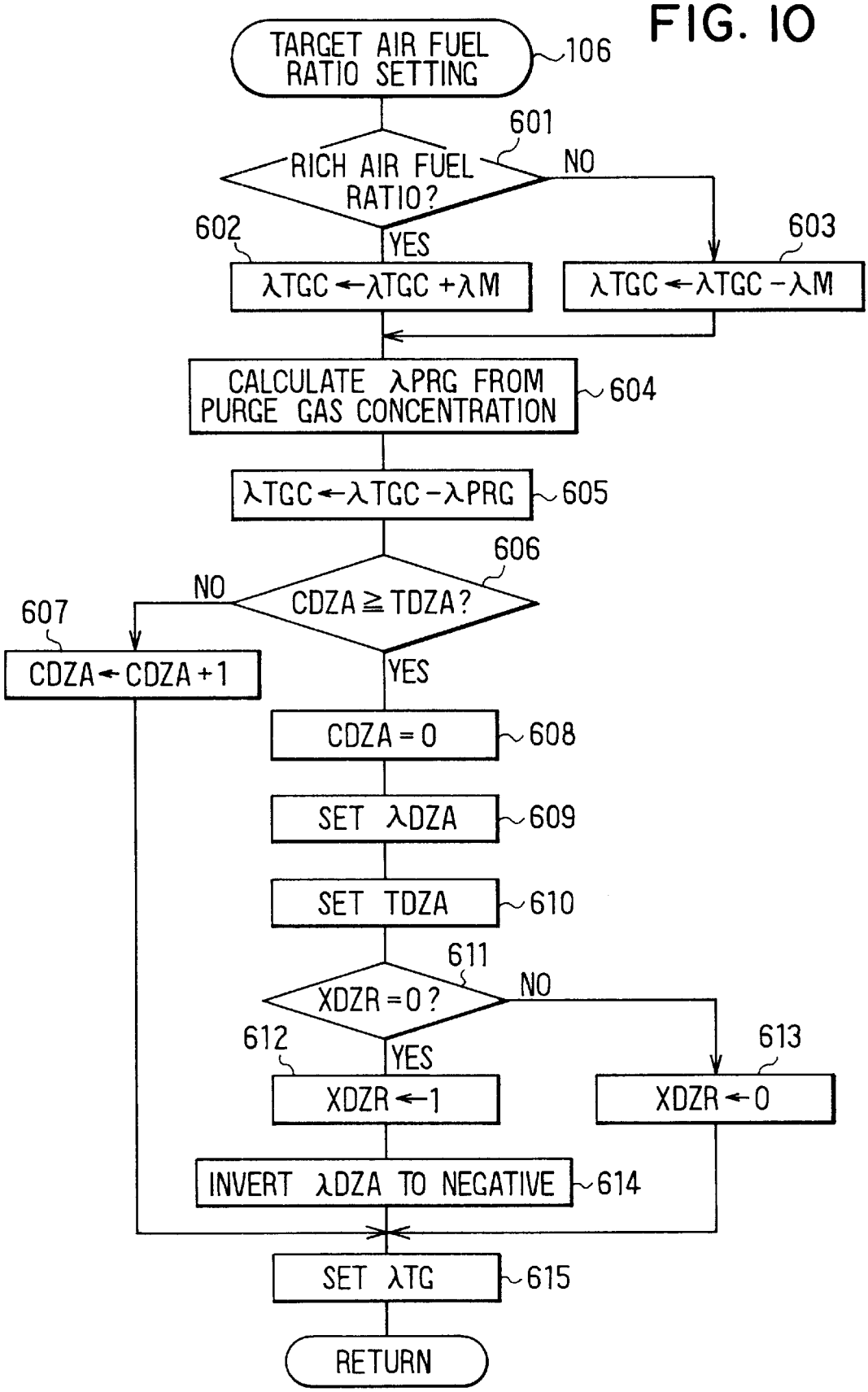
FIG. 10 is a flowchart showing a processing of a target air-fuel ratio setting program executed in the embodiment.

If the determination at step 103 indicates that the air-fuel ratio feedback condition is satisfied, on the other hand, the processing continues to step 105 to determine whether or not the three-way catalyst 27 has been activated. The determination whether or not the three-way catalyst 27 has been activated can be made by for example determining whether or not the coolant temperature THW is equal to or higher than a value of typically 40° C. If the determination at step 105 indicates that the three-way catalyst 27 has been activated, the processing proceeds to step 106 at which a target air-fuel ratio setting program of FIG. 10 is executed and the target air-fuel ratio (target excess air ratio) λTG is set in accordance with the signal R/L output by the oxygen sensor 29 provided on the downstream side of the three-way catalyst 27. Then, the processing continues to step 108.

Figure 3:
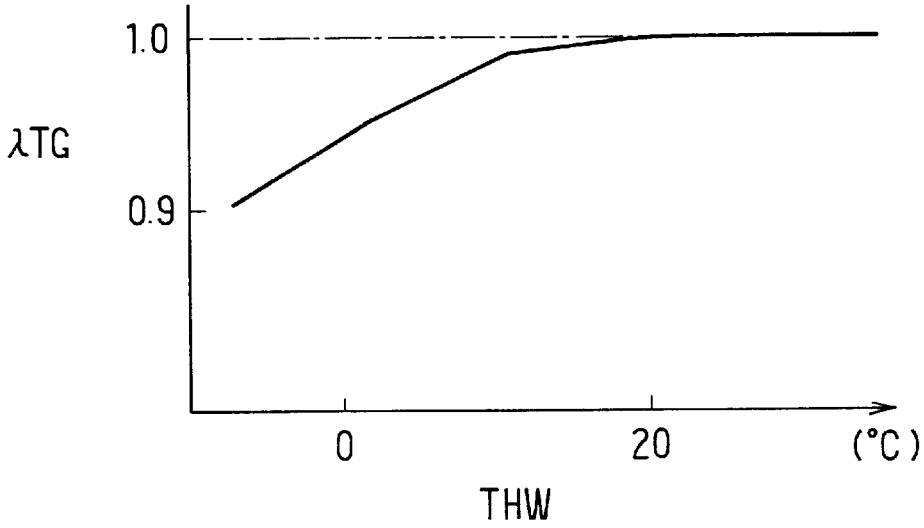
FIG. 3 is a diagram showing a target air-fuel ratio relative to a coolant temperature.

If the determination at step 105 indicates that the three-way catalyst 27 has not been activated, on the other hand, the processing proceeds to step 107 at which a target air-fuel ratio map shown in FIG. 3 is searched for a target air-fuel ratio λTG with the coolant temperature THW used as a parameter. The target air-fuel ratio λTG found in the search which is appropriate for the coolant temperature THW obtained at that time is set. The processing then goes on to step 108.

After the target air-fuel ratio λTG is set at step 106 or 107, the processing continues to step 108 at which the air-fuel ratio correction coefficient FAF is calculated from the target air-fuel ratio λTG and the signal λ output by the air-fuel ratio sensor 28 by using the following equation:

$$FAF(k)=K1\cdot\lambda(k)+K2\cdot FAF(k-3)+K3\cdot FAF(k-2)+K4\cdot FAF(k-1)+ZI(k),$$

$$\text{where } ZI(k)=ZI(k-1)+Ka\cdot\{\lambda TG-\lambda(k)\}$$

In the above equation, the symbol k is a variable representing the number of control executions counted from the start of the first sampling. Notations K1 to K4 are optimum feedback constants and notation Ka is an integration constant. Thus, the processing carried out at step 108 functions to effect the air-fuel ratio feedback control.

The processing then goes on to step 109 at which the fuel injection volume TAU is calculated from the basic fuel injection volume Tp, the air-fuel ratio correction coefficient FAF and a learned correction quantity KGj pertaining to a current operating area, one of learned correction quantities KGj of the air-fuel ratio stored in the backup RAM unit 35, by using the following equation at the end of the program:

$$TAU=Tp\cdot FAF\cdot KGj\cdot FALL$$

where notation FALL is another correction coefficient independent of the air-fuel ratio correction coefficient FAF and the learned correction quantity KGj. Examples of the coefficient FALL include a correction coefficient used at acceleration or deceleration and a correction factor dependent on the temperature of the internal combustion engine 11.

[Purge Rate Control]

Figure 5:
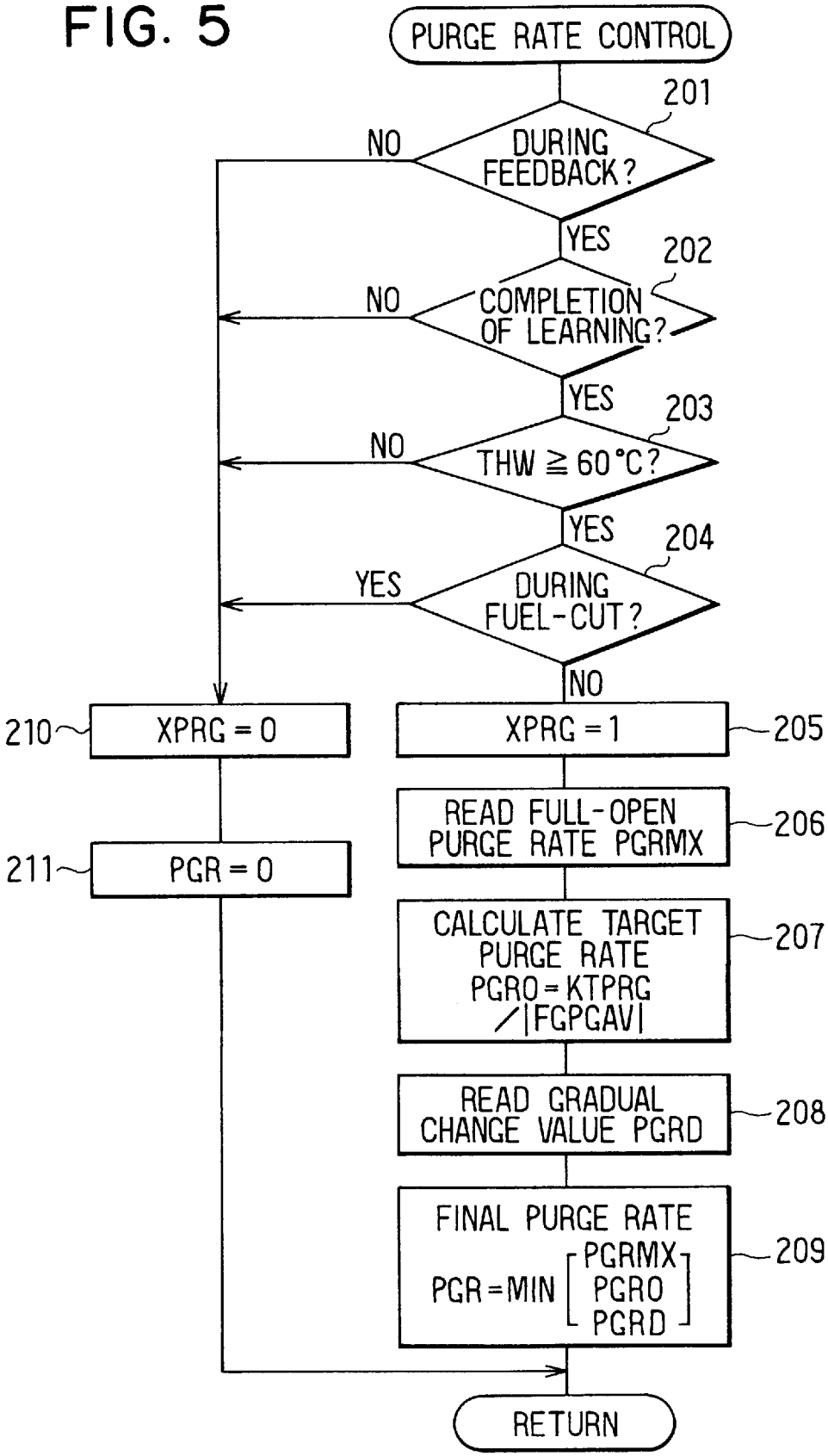
FIG. 5 is a flowchart showing a processing of a purge rate control program executed in the embodiment.

A purge rate control program shown in FIG. 5 is executed as an interrupt at intervals of typically 32 msec. As shown in the figure, this program starts with steps 201 to 204 to determine whether or not purge rate control execution conditions (B1) to (B4) respectively listed below hold true.

(B1) The air-fuel ratio feedback control is being executed (a condition determined at step 201)

(B2) An air-fuel ratio learning process has been completed (a condition determined at step 202)

(B3) The coolant temperature THW is at least 80° C. (a condition determined at step 203)

(B4) A fuel cut is not under way (a condition determined at step 204)

If all the conditions (B1) to (B4) are satisfied, a purge rate control execution condition is to be satisfied. If even only one of them does not hold true, on the other hand, the purge rate control execution condition is not to be satisfied.

If the purge rate control execution condition is not satisfied, the processing goes on to step 210 at which a purge execution flag XPRG is cleared to 0. Then, the processing proceeds to step 211 at which a final purge rate PGR is reset to 0 at the end of this program. The final purge rate PGR having a value of 0 indicates that purging of fuel evaporative gas is not implemented. Prior to the warming up of the internal combustion engine 11, for example, the temperature of the coolant is low (THW<60° C.). In this case, increasing the fuel amount other than purging is implemented by correction of the temperature of the coolant and the purge rate control is not executed.

Figures 6, 7:
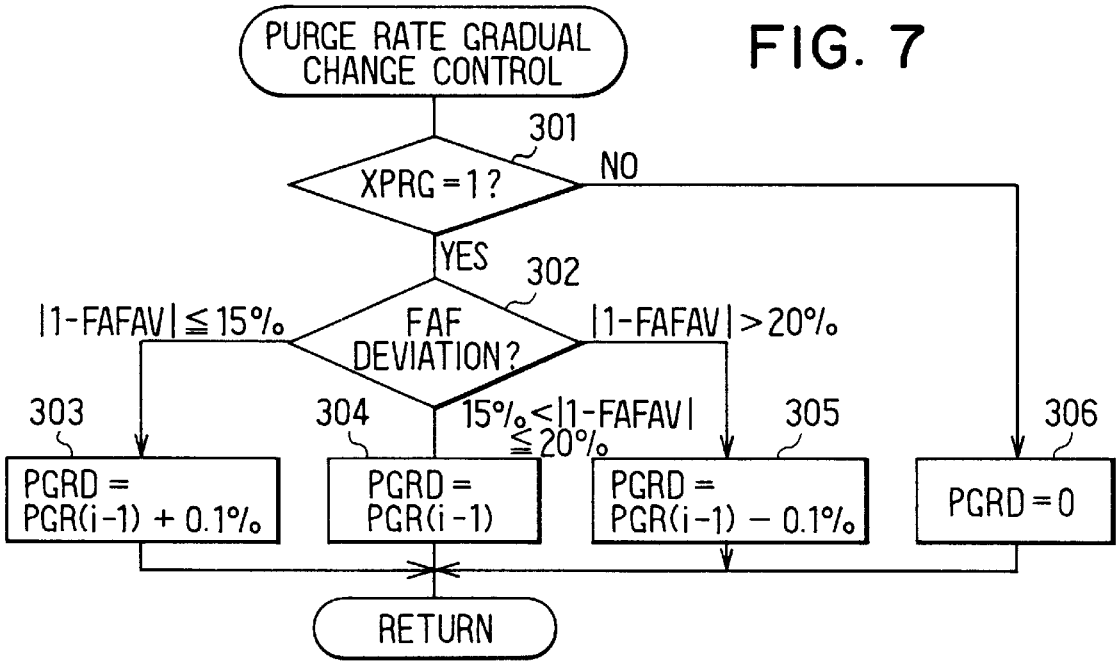
FIG. 6 is a table showing a full-open purge rate.
FIG. 7 is a flowchart showing a processing of a purge rate gradual change control program executed in the embodiment.

If the purge rate control execution condition is satisfied, on the other hand, the processing goes on to step 205 at which the purge implementation flag XPRG is set to 1. Then, at steps 206 to 209, the final purge rate PGR is calculated as follows. First of all, at step 206, a full-open purge rate map shown in FIG. 6 is searched with the intake air pressure PM and the engine revolution speed NE used as parameters for a full-open purge rate PGRMX proper for the pressure PM and the speed NE given at that time. The full-open purge rate PGRMX is a ratio of the volume of air introduced to the purge path 44 with the purge control valve 45 put in fully open state, that is, at a duty ratio of 100%, to the total volume of air flowing to the internal combustion engine 11 by way of the intake pipe 12 .

Figure 8:
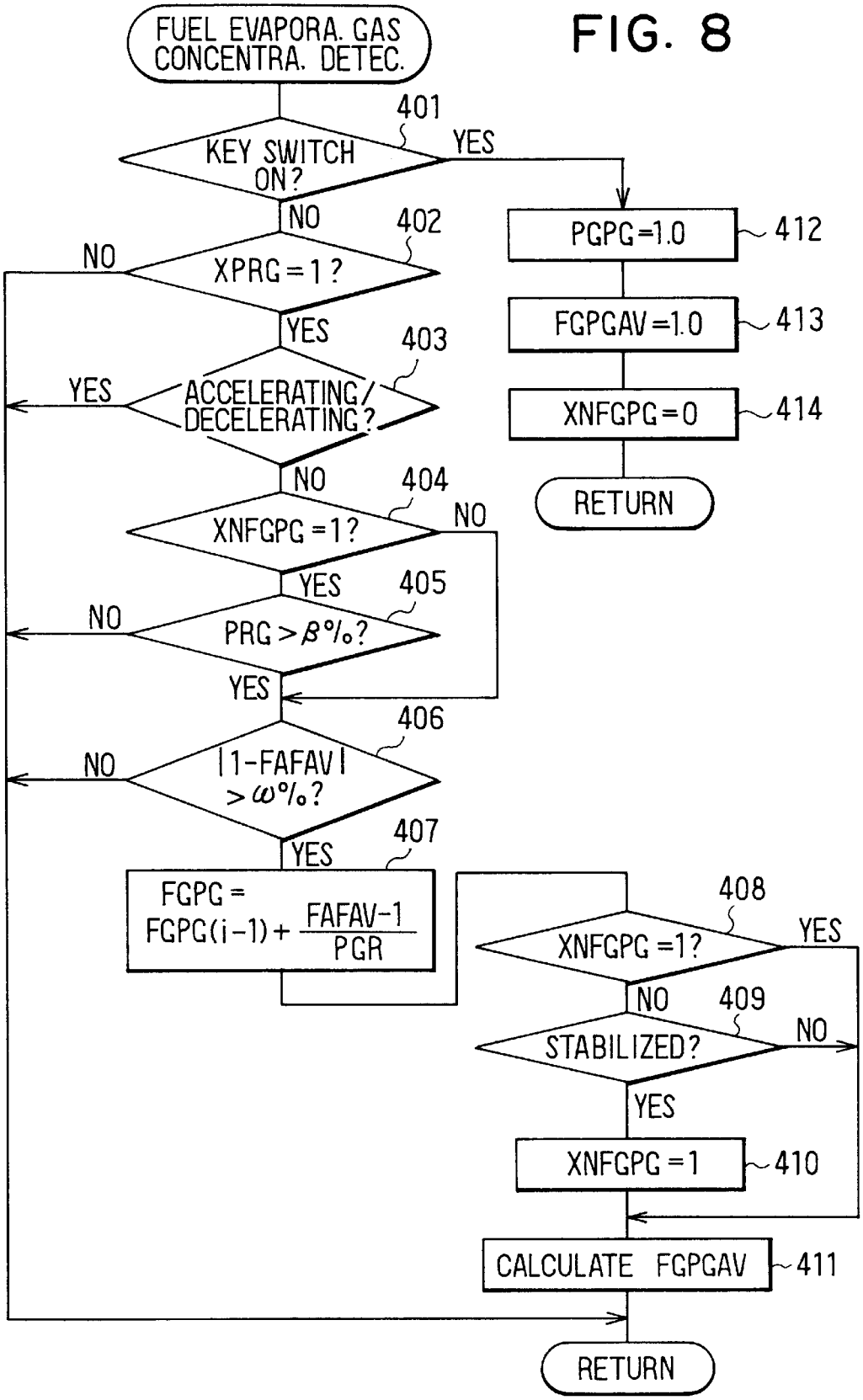
FIG. 8 is a flowchart showing a processing of a fuel evaporative gas concentration detecting program executed in the embodiment.

Then, the processing goes on to step 207 to calculate a target purge rate PGRO by dividing a target TAU correction quantity KTPRG by the absolute value of a fuel evaporative gas concentration average value FGPGAV which is calculated at step 411 of FIG. 8 (PGRO=KTPRG/|FGPGAV|). The target TAU correction quantity KTPRG is a maximum correction quantity used in correction of the fuel injection volume TAU. To be more specific, the target TAU correction quantity KTPRG is a maximum quantity that can be subtracted from the fuel injection volume TAU. The fuel evaporative gas concentration average value FGPGAV represents the volume of fuel evaporative gas adsorbed to the canister 42. The fuel evaporative gas concentration average value FGPGAV is stored in the RAM unit 34 to be updated from time to time. Thus, the target purge rate PGRO indicates how much fuel evaporative gas should be furnished as replenishment purge gas on the assumption that the target TAU correction quantity KTPRG is all subtracted from the fuel injection volume TAU. For the same operating state, the larger the fuel evaporative gas concentration average value FGPGAV, the smaller the target purge rate PGRO. It should be noted that, in the present embodiment, the target TAU correction quantity KTPRG is set at a typical value of 30%.

After the target purge rate PGRO has been calculated, the processing proceeds to step 208 at which a purge rate gradual change value PGRD is read in. The purge rate gradual change value PGRD is a control quantity for avoiding a state in which correction is not capable of keeping up with a sudden large increase in purge rate, making it impossible to sustain an optimum air-fuel ratio. The purge rate gradual change value PGRD is set by adopting a method based on purge rate gradual change control.

After the full-open purge rate PGRMX, the target purge rate PGRO and the purge rate gradual change value PGRD have been set, the processing continues to step 209 to select the smallest among the full-open purge rate PGRMX, the target purge rate PGRO and the purge rate gradual change value PGRD as a final purge rate PGR at which purge control is to be executed. In this case, the final purge rate PGR is normally controlled to the purge rate gradual change value PGRD. If the purge rate gradual change value PGRD keeps increasing, however, the final purge rate PGR is guarded at an upper limit which is set to either the full-open purge rate PGRMX or the target purge rate PGRO.

[Purge rate Gradual Change Control]

A purge rate gradual change control program shown in FIG. 7 is executed as an interrupt processing at intervals of typically 32 msec. As shown in the figure, this program starts with step 301 to determine whether the purge execution flag XPRG is set at 0 or 1. If XPRG=0, that is, if the purge rate control is not executed, the processing goes on to step 306 at which the purge rate gradual change value PGRD is set to 0.

If XPRG=1, on the other hand, the processing proceeds to step 302 at which a deviation or shift |1-FAFAV| of the air-fuel ratio feedback correction coefficient FAF is evaluated. If |1-FAFAV|≦15%, the processing continues to step 303 at which the purge rate gradual change value PGRD is set at a value obtained by adding 0.1% to a previous final purge rate PGR(i−1). If 15%<|1-FAFAV|≦20%, the processing goes on to step 304 at which the purge rate gradual change value PGRD is maintained at the previous final purge rate PGR(i−1).

If |1-FAFAV|>20%, the processing continues to step 305 at which the purge rate gradual change value PGRD is set at a value obtained by subtracting 0.1% from the previous final purge rate PGR(i−1). As described above, the purge rate gradual change value PGRD is used for solving a problem caused by the fact that correction is not capable of keeping up with a sudden large increase in purge rate, making it impossible to sustain an optimum air-fuel ratio.

[Detection of Concentration of Fuel Evaporative Gas]

A purge rate gradual change control program shown in FIG. 8 is executed as an interrupt processing routine at intervals of typically 4 msec. As shown in the figure, this program starts with step 401 to determine whether or not a key switch of a vehicle (not shown) is just turned on. If the key switch is just turned on, the processing goes on to steps 412 to 414 at which variables are initialized. To be more specific, a fuel evaporative gas concentration FGPG is set at 1.0 at step 412, a fuel evaporative gas concentration average value FGPGAV is set at 1.0 at step 413 and an initial concentration detection completion flag XNFGPG is reset at 0 at step 414.

Here, the fuel evaporative gas concentration FGPG set at 1.0 and the fuel evaporative gas concentration average value FGPGAV set at 1.0 indicate that the concentration of the fuel evaporative gas is 0, that is, no fuel evaporative gas has been adsorbed in the canister 42 at all. When the internal combustion engine 11 is started, the volume of fuel evaporative gas adsorbed into the canister 42 is assumed to be initially 0. The initial concentration detection completion flag XNFGPG reset at 0 indicates that no concentration of the fuel evaporative gas has been detected after the internal combustion engine 11 is started.

After the key switch is turned on, on the other hand, the processing goes on to step 402 to determine whether the purge execution flag XPRG is 0 or 1, that is, whether or not the purge control has been started. If XPRG=0, that is, if the purge control has not been started, the program is finished. If XPRG=1, that is, if the purge control has been started, on the other hand, the processing proceeds to step 403 to determine whether or not the vehicle is being accelerated/decelerated. The determination whether or not the vehicle is being accelerated/decelerated can be based on a result of detection of, the on/off state of an idle switch 46, a change in opening of the throttle valve 14, a change in intake air pressure and a change in vehicle speed. If the determination at step 403 indicates that the vehicle is being accelerated or decelerated, the program is finished. That is, while the vehicle is being accelerated or decelerated or during a transient state of the engine operation, detection of the concentration of the fuel evaporative gas is prohibited in order to avoid incorrect detection.

If the determination at step 403 indicates that the vehicle is operated under a generally stable condition and is neither accelerated nor decelerated, on the other hand, the processing continues to step 404 to determine whether the initial concentration detection completion flag XNFGPG is 1 or 0, that is, whether an initial detection of the concentration of the fuel evaporative gas has been completed or not. If XNFGPG=1, that is, if the initial detection of the concentration of the fuel evaporative gas has been completed, the processing goes on to step 405. If XNFGPG=0, that is, if the initial detection of the concentration of the fuel evaporative gas has not been completed, on the other hand, the processing goes on to step 406.

Initially, the initial detection of the concentration of the fuel evaporative gas has not been completed, that is, XNFGPG=0. Thus, the processing proceeds from step 404 to step 406 to determine whether or not a smoothed average value FAFAV of the air-fuel ratio feedback correction coefficient deviates from a reference value of 1 by at least a predetermined deviation $\omega$ of typically 2%. That is, if the shift of the air-fuel ratio due to fuel evaporative gas purging is too small, the concentration of the fuel evaporative gas can not be detected correctly. For this reason, if the shift of the air-fuel ratio is too small ($|1\text{-FAFAV}| \leqq \omega$), the program is finished.

If the shift of the air-fuel ratio is large ($|1\text{-FAFAV}| > \omega$), on the other hand, the processing goes on to step 407 at which the fuel evaporative gas concentration FGPG is calculated by using the following equation:

$$FGPG=FGPG(i-1)+(FAFAV-1)/PGR$$

In the above equation, the initial value of the fuel evaporative gas concentration FGPG is 1 and is updated gradually in dependence on whether the air-fuel ratio is on the rich or lean side than the stoichiometric ratio.

In this case, the higher the actual concentration of the fuel evaporative gas, that is, the larger the volume of fuel evaporative gas adsorbed in the canister 23, the larger the decrease in fuel evaporative gas concentration FGPG from a reference value of 1. In addition, the value of the fuel evaporative gas concentration FGPG is increased in accordance with a decrease in actual fuel evaporative gas concentration (a decrease in volume of gas purged from the canister 23). Specifically, if the air-fuel ratio is on the rich side (FAFAV−1<0), the value of the fuel evaporative gas concentration FGPG is decreased by a quotient resulting from division of (FAFAV−1) by the final purge rate PGR. If the air-fuel ratio is on the lean side (FAFAV−1>0), on the other hand, the value of the fuel evaporative gas concentration FGPG is increased by a quotient resulting from division of (FAFAV−1) by the final purge rate PGR.

The processing then proceeds to step 408 to determine whether the initial concentration detection completion flag XNFGPG is 1 or 0. If XNFGPG=0, the processing continues to step 409 to determine whether or not a difference between the immediately preceding and current detected values of the fuel evaporative gas concentration FGPG equal to or smaller than a predetermined value of typically 3% is detected at least 3 times consecutively in order to determine whether or not the fuel evaporative gas concentration FGPG is stable. If the fuel evaporative gas concentration FGPG is found stable, the processing goes on to step 410 at which the initial concentration detection completion flag XNFGPG is set to 1. The processing then proceeds to step 411.

If the determination at step 408 indicates XNFGPG=1 or the determination at step 409 indicates that the fuel evaporative gas concentration FGPG is not stable, on the other hand, the processing jumps directly to step 411 at which predetermined smoothing or averaging processing such as 1/64 smoothing or averaging processing is carried out for calculating a smoothed value of the current fuel evaporative gas concentration FGPG to be used as an average value FGPGAV of the fuel evaporative gas concentration.

As the initial concentration detection is completed as above, the initial concentration detection completion flag XNFGPG is set to 1 which always cause the determination at step 404 to become 'Yes', leading the processing to step 405 to determine whether or not the final purge rate PGR exceeds a predetermined value $\beta$ of typically 0%. Only if PGR>$\beta$ are processing to detect the concentration of the fuel evaporative gas starting with step 406 carried out. That is, the final purge rate PGR may be 0 even if the purge execution flag XPRG is set. This is because, actually, the purging of fuel evaporative gas may not be implemented. For this reason, for PGR=0, detection of the concentration of the fuel evaporative gas is not carried out except the initial detection.

It should be noted that, in the case of a small final purge rate PGR, that is, when the purge control valve 31 is controlled on the low flow rate side, the precision of the opening control is relatively low, decreasing the reliability of the detection of the fuel evaporative gas concentration. In order to solve this problem, the predetermined value $\beta$ used in the determination at step 405 is set in a range corresponding to a low opening of the purge control valve 31, for example, $0\% < \beta < 2\%$. In this way, detection of the concentration of the fuel evaporative gas is carried out only if a detection condition to produce high precision is satisfied except the initial detection.

[Purge Valve Control]

Figure 9:
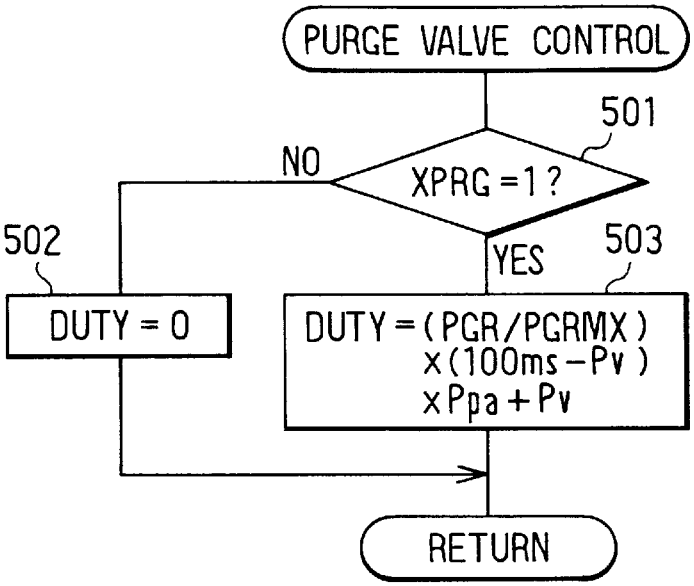
FIG. 9 is a flowchart showing a processing of a purge control valve control program executed in the embodiment.

A purge control valve control program shown in FIG. 9 is executed as an interrupt processing routine at intervals of typically 100 msec. As shown in the figure, this program starts with step 501 to determine whether the purge execution flag XPRG is 1 indicating execution of purging or 0. If XPRG=0 indicating that the purging is not executed, the processing goes on to step 502 at which a control quantity Duty for driving the purge control valve 45 is set at 0. If XPRG=1 indicating that the purging is executed, on the other hand, the processing goes on to step 503 at which the control quantity Duty is calculated from the final purge rate PGR and the full-open purge rate PGRMX appropriate for the current operating state by using the following equation:

$$Duty=(PGR/PGRMX)\cdot(100-Pv)\cdot Ppa+Pv$$

In the above equation, the driving period of the purge control valve 45 is set at 100 msec. Notation Pv is a voltage correction value for variations in battery voltage and notation Ppa is atmospheric pressure correction value for variations in atmospheric pressure. The voltage correction value Pv can also be an equivalent period of time for correction of the driving period. The duty ratio of a pulse signal for driving the purge control valve 45 is set on the basis of the control quantity Duty found from the above equation.

[Target Air-fuel Ratio Setting]

A purge control valve control program shown in FIG. 10 is a routine executed at step 106 of the air-fuel ratio control program shown in FIG. 4. As shown in the figure, this program starts with steps 601 to 603 at which a central value λTGC of the target air-fuel ratio is set so as to correct a shift or deviation between an actual air-fuel ratio and a detected air-fuel ratio λ output by the air-fuel ratio sensor 28 in dependence on the logic value of the output R/L of the oxygen sensor 29. Specifically, the setting of the central value λTGC begins with step 601 to determine whether the output R/L of the oxygen sensor 29 is on the rich (R) or lean (L) side. If the output R/L of the oxygen sensor 29 is on the rich (R) side, the processing goes on to step 602 at which the central value λTGC is increased by a predetermined value λM. That is, the central value λTGC of the target air-fuel ratio is set toward the lean side (λTGC←λTGC+λM).

Figure 11:
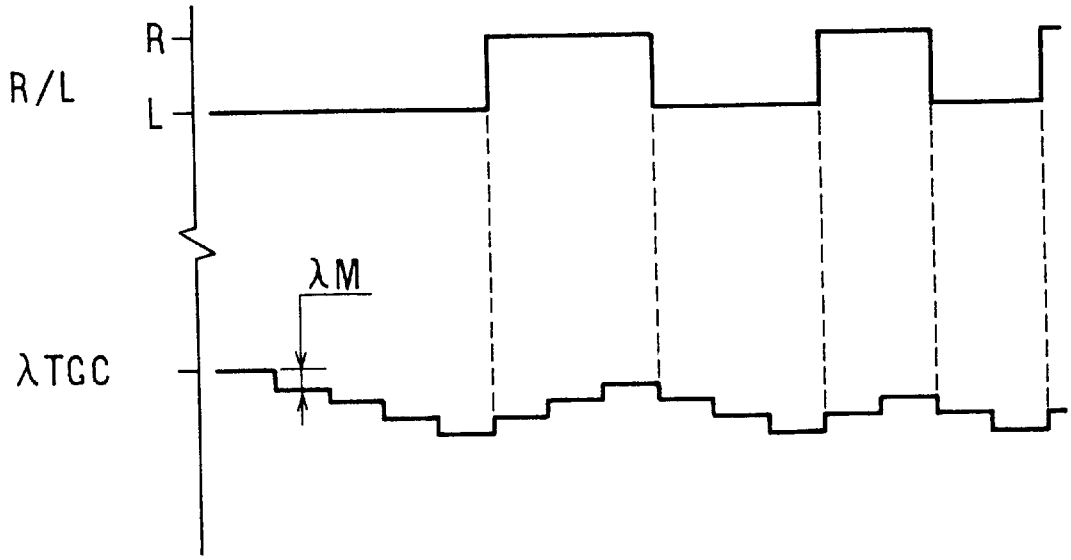
FIG. 11 is a time chart showing a relation between a central value λTGC of the target air-fuel ratio and an output of an oxygen sensor.

If the output R/L of the oxygen sensor 29 is on the rich (L) side, on the other hand, the processing goes on to step 603 at which the central value λTGC is decreased by a predetermined value λM. That is, the central value λTGC of the target air-fuel ratio is set toward the rich side (λTGC←λTGC−λM). FIG. 11 is a diagram showing how the central value λTGC of the target air-fuel ratio is typically set in dependence on the logic value of the output R/L of the oxygen sensor 29.

After the central value λTGC of the target air-fuel ratio has been set as described above, the processing goes on to step 604 at which a target air-fuel ratio correction quantity λPRG is calculated in accordance with the concentration of the purge gas. The concentration of the purge gas is a ratio of a purge gas (fuel evaporative gas) component to the fuel supplied to the internal combustion engine 11. The concentration of the purge gas is calculated from quantities such as the fuel evaporative gas concentration average value FGPGAV and the control duty Duty of the purge control valve 45.

Figure 13:
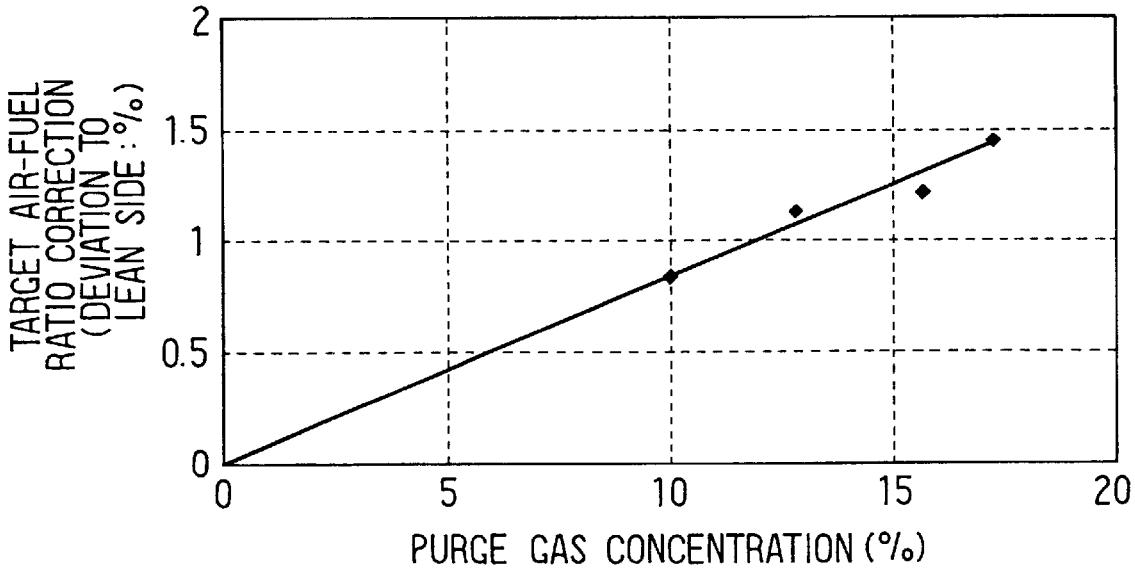
FIG. 13 is a diagram showing a relation between a deviation of the air-fuel ratio from a catalyst window to the lean side and the concentration of purge gas.
Figure 16:
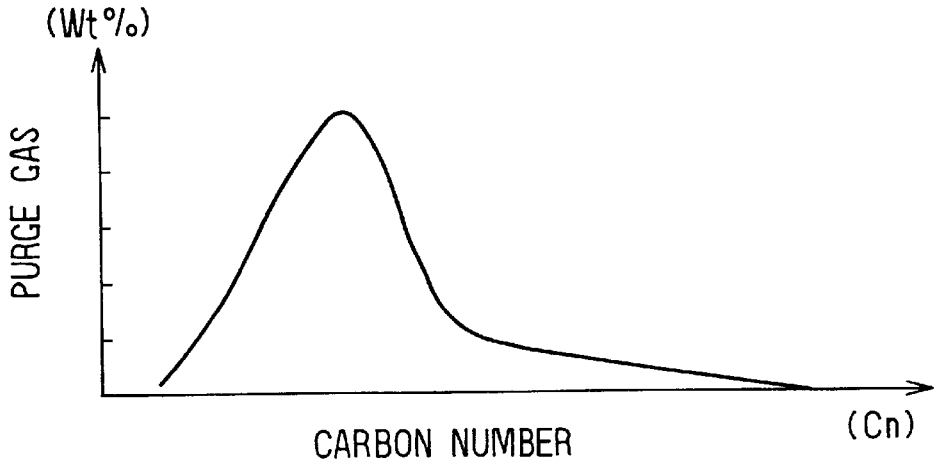
FIG. 16 PRIOR ART
FIG. 16 is a diagram showing a distribution of hydrocarbon components contained in purge gas.

A relation between the concentration of the purge gas and the target air-fuel ratio correction quantity λPRG is explained by referring to FIG. 13. The purge gas contains a number of hydrocarbon components each with a low carbon number such as methane, ethane, propane, butane and pentane with carbon numbers C1, C2, C3, C4 and C5 respectively, as discussed with reference to FIG. 16. The stoichiometric air-fuel ratios of these hydrocarbon components are in the range 17.24 to 15.36 which is higher than the range 14.6 to 14.7 of the stoichiometric air-fuel ratio of the fuel as a whole. Thus, during the introduction of purge gas, the stoichiometric air-fuel ratio of the fuel as a whole supplied to the internal combustion engine becomes higher than the stoichiometric air-fuel ratio of ordinary fuel which is in the range 14.6 to 14.7.

A relation between the shift of the air-fuel ratio toward the lean side from a window of the three-way catalyst 27 occurring during introduction of purge gas and the concentration of the purge gas was examined and its results are shown in FIG. 13. It is understood from the figure that, as the concentration of the purge gas increases, the shift of the air-fuel ratio toward the lean side also increases almost in proportion to the increase in concentration. Therefore, in the present embodiment, the target air-fuel ratio is corrected or changed to a value on the fuel-rich side during the introduction of purge gas so as to cancel the shift of the air-fuel ratio toward the lean side from the catalyst window (high purification range of catalyst).

For the correction of the target air-fuel ratio to a value on the rich side during the introduction of purge gas, a map or table of the target air-fuel ratio correction quantity λPRG with the concentration of the purge gas used as a parameter is set and stored in the ROM unit 33. The map of the target air-fuel ratio correction quantity λPRG is set by considering the shift of the air-fuel ratio toward the lean side from the catalyst window occurring during the introduction of purge gas shown in FIG. 13. To be more specific, the map is set so that, as the concentration of the purge gas increases, the target air-fuel ratio correction quantity λPRG also increases almost in proportion to the increase in concentration. In addition, the map of the target air-fuel ratio correction quantity λPRG is set by considering the stoichiometric air-fuel ratios of the hydrocarbon components contained in the purge gas.

At step 604 of the flowchart shown in FIG. 10, a target air-fuel ratio correction quantity λPRG appropriate for the concentration of the purge gas is found from the map of the target air-fuel ratio correction quantity λPRG. Then, the processing goes on to step 605 at which the central value λTGC of the target air-fuel ratio is corrected toward the rich side by the target air-fuel ratio correction quantity λPRG (λTGC←λTGC−λPRG). Thus, the processing carried out at steps 604 and 605 function to correct the target air-fuel ratio.

Subsequently, the processing proceeds to steps 606 to 615 at which the target air-fuel ratio λTG is set by execution of the so-called dither control explained as follows. The dither control begins with step 606 to determine whether or not a count value CDZA of a dither counter is equal to or greater than a dither period TDZA. The dither period TDZA is a factor used for determining the resolution of the dither control. The dither period TDZA is updated for each execution of the dither control to a value desirable for the operating state of the internal combustion engine 11 by processing carried out at step 610.

If the count value CDZA of the dither counter is found smaller than the dither period TDZA, the processing continues to step 607 at which the count value CDZA of the dither counter is incremented by 1. The processing then goes on to step 615. In this case, the target air-fuel ratio λTG set at that point of time is sustained without updating the value of the target air-fuel ratio λTG.

Figure 12:
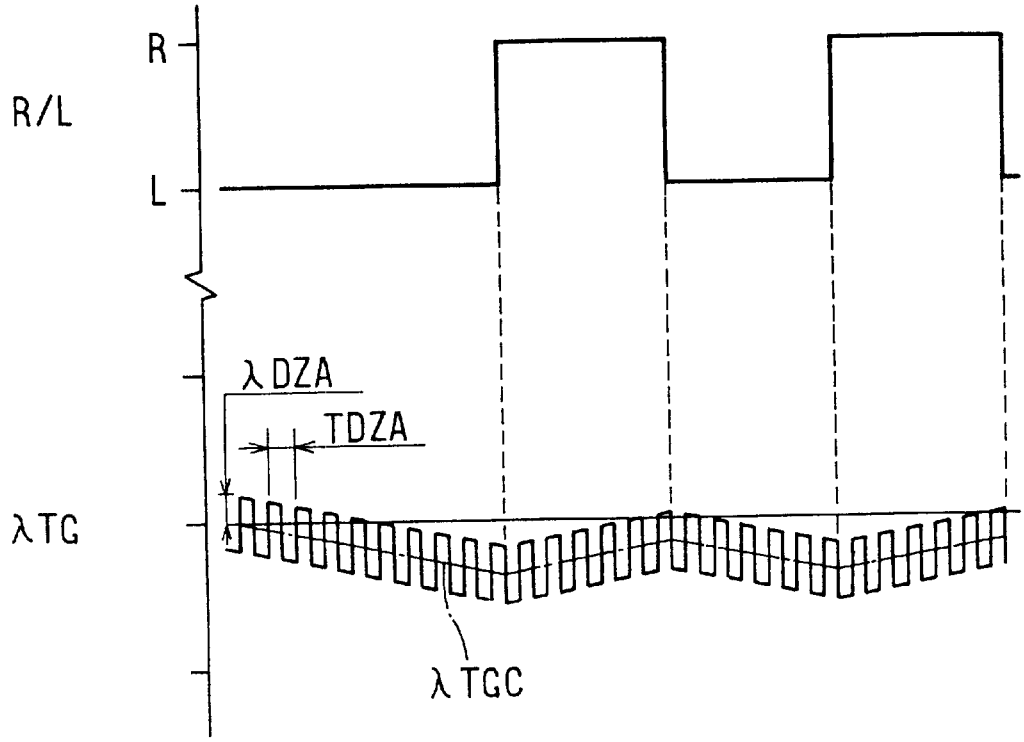
FIG. 12 is a time chart showing a relation between the output of the oxygen sensor and the target air-fuel ratio λTG.

If the count value CDZA of the dither counter is found equal to or greater than the dither period TDZA, on the other hand, the processing proceeds to step 608 at which the count value CDZA of the dither counter is reset to 0. Then, the following processing of the dither control is carried out so that the target air-fuel ratio λTG changes to form an alternating pulse waveform centering at the center value λTGC of the target air-fuel ratio as shown in FIG. 12.

First of all, a dither amplitude λDZA and the dither period TDZA are set at steps 609 and 610 respectively. The dither amplitude λDZA is a factor used for determining a control quantity of the dither control. Much like the dither period TDZA, the dither amplitude λDZA is updated for each execution of the dither control to a value desirable for the operating state of the internal combustion engine 11. A two-dimensional map not shown in the figure is provided for determining the dither amplitude λDZA and the dither period TDZA with the engine revolution speed Ne and the intake air pressure PM each used as a parameter. To be more specific, the two-dimensional map is searched for a dither amplitude λDZA and a dither period TDZA appropriate for an engine revolution speed Ne and an intake air pressure PM detected at that time.

Then, the processing continues to step 611 to determine whether a dither processing flag XDZR is 0 or 1. A value of 1 is set in the dither processing flag XDZR when the target air-fuel ratio λTG has been set on the rich side with respect to the center value λTGC of the target air-fuel ratio. On the other hand, a value of 0 is set in the dither processing flag XDZR when the target air-fuel ratio λTG has been set on the lean side with respect to the center value λTGC of the target air-fuel ratio.

If the determination at step 611 indicates XDZR=0 indicating that the target air-fuel ratio λTG has been set on the lean side with respect to the center value λTGC of the target air-fuel ratio, the processing goes on to step 612 at which the dither processing flag XDZR is set to 1 because the target air-fuel ratio λTG will be set on the rich side with respect to the center value λTGC of the target air-fuel ratio in the current execution of the dither control this time. The processing then continues to the following step 614 at which the polarity of the dither amplitude λDZA is inverted.

If the determination at step 611 indicates XDZR=1 indicating that the target air-fuel ratio λTG has been set on the rich side with respect to the center value λTGC of the target air-fuel ratio, on the other hand, the processing goes on to step 613 at which the dither processing flag XDZR is reset to 0 because the target air-fuel ratio λTG will be set on the lean side with respect to the center value λTGC of the target air-fuel ratio in the current execution of the dither control this time at step 614.

Then, the processing proceeds to step 615 at which the target air-fuel ratio λTG is set by using the center value λTGC of the target air-fuel ratio and the dither amplitude λDZA as follows. If the target air-fuel ratio λTG has been set on the lean side with respect to the center value λTGC of the target air-fuel ratio, the target air-fuel ratio λTG is set on the rich side with respect to the center value λTGC of the target air-fuel ratio in the current execution of the dither control this time by using the following equation to calculate the target air-fuel ratio λTG:

$$\lambda TG=\lambda TGC-\lambda DZA$$

If the target air-fuel ratio λTG has been set on the rich side with respect to the center value λTGC of the target air-fuel ratio, on the other hand, the target air-fuel ratio λTG is set on the lean side with respect to the center value λTGC of the target air-fuel ratio in the current execution of the dither control this time by using the following equation to calculate the target air-fuel ratio λTG:

$$\lambda TG=\lambda TGC+\lambda DZA$$

Such dither control results in a target air-fuel ratio λTG which changes to form an alternating pulse waveform centering at the center value λTGC of the target air-fuel ratio with an amplitude equal to the dither amplitude λDZA as shown in FIG. 12.

Figure 14:
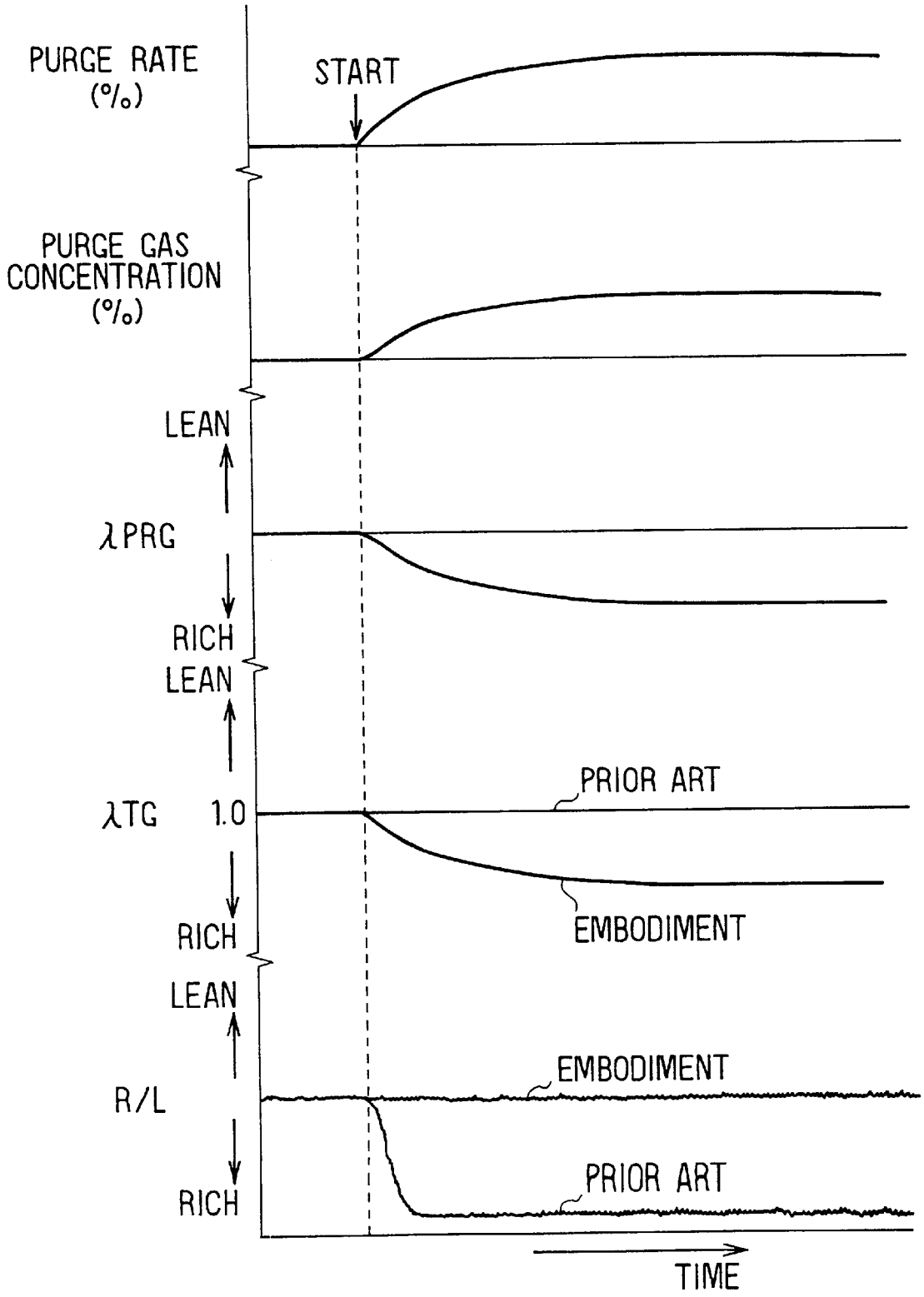
FIG. 14 is a time chart showing operation of an air-fuel ratio feedback control executed during introduction of purge gas in the embodiment.
Figure 15:
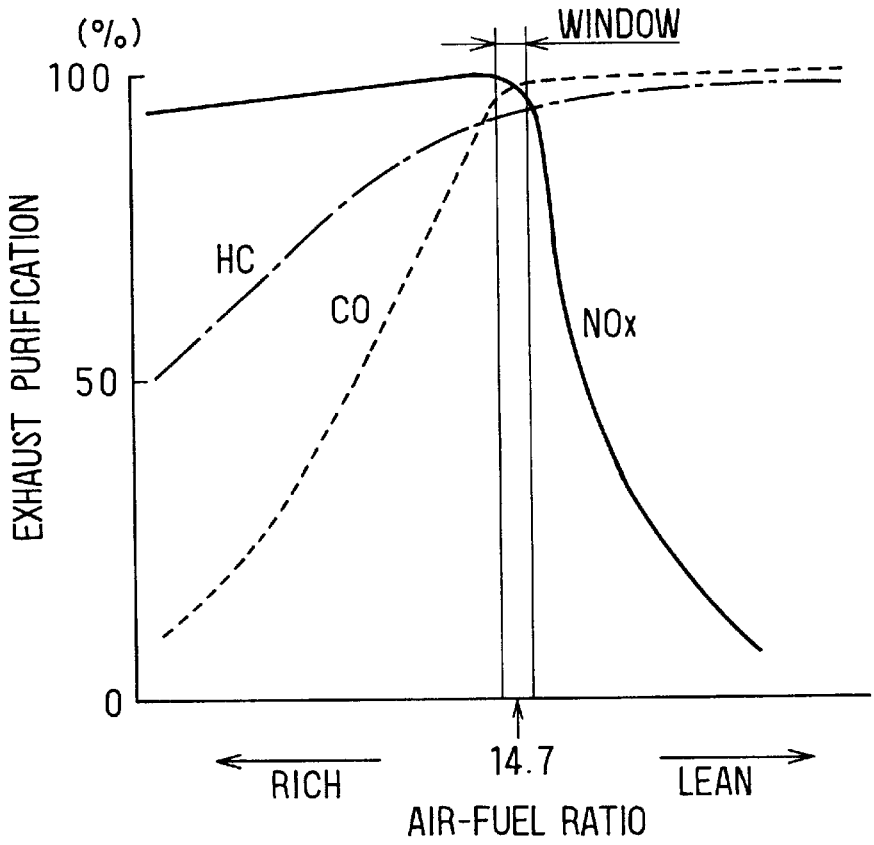
FIG. 15 PRIOR ART
FIG. 15 is a diagram showing a catalyst window.

The operation of the above air-fuel ratio feedback control of the embodiment is shown in FIG. 14. When the purging of fuel evaporative gas from the canister 42 is started, the concentration of the purge gas begins to rise. In accordance with the increase in purge gas concentration, the target air-fuel ratio correction quantity λPRG is changed to correct the target air-fuel ratio λTG to a value on the rich side.

Provided that the target air-fuel ratio λTG is maintained unchanged and not corrected even during introduction of purge gas as in the prior art, the air-fuel ratio is shifted from the catalyst window to the lean side during the introduction of purge gas, decreasing the efficiency of the purifying of NOx. This is because the stoichiometric air-fuel ratios of hydrocarbon components contained in the purge gas in the range 17.2 to 15.3 are higher than the stoichiometric air-fuel ratio of ordinary fuel which is in the range 14.6 to 14.7.

In the case of the present embodiment, on the other hand, the target air-fuel ratio λTG is corrected to a value on the rich side during the introduction of purge gas in accordance with the concentration of the purge gas so as to cancel the shift of the air-fuel ratio toward the lean side from the catalyst window caused by the introduction of purge gas. As a result, the air-fuel ratio of the air-fuel mixture detected during the introduction of purge gas can be controlled to a value in the catalyst window, allowing in particular a high efficiency of the purifying of NOx to be maintained even during the introduction of purge gas and in general the efficiency of the purifying of gas exhausted during the introduction of purge gas to be increased.

As described above, in the present embodiment, the target air-fuel ratio is corrected to a value on the fuel-rich side during introduction of purge gas by using a map or a table. It should be noted, however, that the target air-fuel ratio can also be corrected by a mathematical calculation.

As an alternative, the target air-fuel ratio correction quantity used during the introduction of purge gas to correct the target air-fuel ratio to a value on the rich side can be set at a fixed value. Even in this case, the efficiency of the purifying of NOx can be increased to a value higher than that of the conventional engine control system.

Also in the case of the present embodiment, the target air-fuel ratio correction quantity used during the introduction of purge gas to correct the target air-fuel ratio to a value on the rich side is set at a value dependent on the concentration of the purge gas. It should be noted that, in place of the concentration of the purge gas, the target air-fuel ratio correction quantity can also be set in accordance with a control quantity such as the weight of the purge gas, the flow rate of the purge gas or the control duty of the purge control valve 45.

The present invention should not be limited to the above embodiment but may be modified or changed further without departing from the spirit of the invention.

What is claimed is:

1. An air-fuel ratio control apparatus for an internal combustion engine provided with a fuel evaporative emission purge system for adsorbing fuel evaporative gas generated from a fuel tank into a canister by the canister and introducing the fuel evaporative gas from the canister to an intake path of the internal combustion engine under a predetermined operating condition, the air-fuel ratio control apparatus comprising:

air-fuel ratio feedback control means for executing feedback control to adjust an air-fuel ratio of the air-fuel mixture to a target air-fuel ratio; and target air-fuel ratio correcting means for correcting the target air-fuel ratio to a value on a fuel rich side during introduction of the fuel evaporative gas by the fuel evaporative emission purge system to the intake path;

wherein said air-fuel ratio feedback control means executes feedback control to re-adjust the air-fuel ratio of the air-fuel mixture based on the value of the corrected target air-fuel ratio from said target air-fuel ratio correcting means.

2. The air-fuel ratio control apparatus according to claim 1, wherein:

the target air-fuel ratio correcting means sets a correction quantity to shift the target air-fuel ratio to the rich side on a basis of a volume of the fuel evaporative gas introduced to the intake path.

3. The air-fuel ratio control apparatus according to claim 2, wherein:

the target air-fuel ratio correcting means sets the correction quantity on a basis of a ratio of the volume of the fuel evaporative gas introduced into the intake path to the volume of fuel supplied to the internal combustion engine.

4. The air-fuel ratio control apparatus according to claim 3, wherein:

the target air-fuel ratio correcting means increases the correction quantity as the ratio of the volume of fuel evaporative gas to the volume of fuel increases.

5. The air-fuel ratio control apparatus according to claim 1, wherein:

the target air-fuel ratio correcting means sets a correction quantity to shift the target air-fuel ratio to the rich side, on a basis of the volume of the fuel evaporative gas introduced to the intake path and gas component thereof.

6. The air-fuel ratio control apparatus according to claim 1, further comprising:

an air-fuel ratio sensor for sensing the air-fuel ratio on an upstream side of a catalyst provided in an exhaust system of the internal combustion, so that the air-fuel ratio feedback control means executes feedback control to adjust the air-fuel ratio sensed by the air-fuel ratio sensor to the target air-fuel ratio.

7. The air-fuel ratio control apparatus according to claim 1, further comprising:

determining means for determining a concentration of the fuel evaporative gas introduced into the intake path, so that the target air-fuel ratio is corrected to the rich side in accordance with the determined concentration of the fuel evaporative gas.

8. The air-fuel ratio control apparatus according to claim 1, further comprising:

purge control means for controlling variably an introduction of the fuel evaporative gas into the intake path in accordance with operating state of the internal combustion engine.

9. The air-fuel ratio control apparatus according to claim 8, wherein:

the purge control means controls the introduction of the fuel evaporative gas gradually in accordance with a deviation of the air-fuel ratio from the target air-fuel ratio.

10. An air-fuel ratio control apparatus for an internal combustion engine provided with a fuel evaporative emission purge system for adsorbing fuel evaporative gas generated from a fuel tank into a canister by the canister and introducing the fuel evaporative gas from the canister to an intake path of the internal combustion engine under a predetermined operating condition, the air-fuel ratio control apparatus comprising:

air-fuel ratio feedback control means for executing feedback control to adjust an air-fuel ratio of the air-fuel mixture to a target air-fuel ratio; and target air-fuel ratio correcting means for correcting the target air-fuel ratio to a value on a fuel rich side during introduction of the fuel evaporative gas by the fuel evaporative emission purge system to the intake path;

wherein the target air-fuel ratio correcting means further corrects the target air-fuel ratio on a basis of an actual air-fuel ratio on the downstream side of a catalyst provided in an exhaust system of the internal combustion engine.

11. An air-fuel ratio control method for an internal combustion engine comprising the steps of:

detecting an air-fuel ratio of air-fuel mixture supplied to the internal combustion engine;

feedback-controlling an air-fuel ratio of the mixture to a target air-fuel ratio in response to the detected air-fuel ratio;

controlling a purging of fuel evaporative gas to an intake path of the internal combustion engine in accordance with an operating condition of the internal combustion engine; and correcting the target air fuel ratio to a value on a fuel rich side during the purging of the fuel evaporative gas than during non-purging of the fuel evaporative gas; and feedback-controlling said air-fuel ratio of the mixture to re-adjust the air-fuel ratio of the air-fuel mixture based on the value of the corrected target air-fuel ratio.

12. The air-fuel ratio control method according to claim 11, wherein:

the purging controlling step purges the fuel evaporative gas gradually in accordance with a deviation of the air-fuel ratio from the target air-fuel ratio.

13. The air-fuel ratio control method according to claim 11, further comprising:

determining a concentration of the fuel evaporative gas so that the target air-fuel ratio is corrected to the rich side in accordance with the determined concentration of the fuel evaporative gas.

14. The air-fuel ratio control method according to claim 11, wherein:

the correcting step corrects the target air-fuel ratio variably in accordance with a ratio of a volume of the fuel evaporative gas to a volume of fuel supplied to the internal combustion engine.

15. An air-fuel ratio control method for an internal combustion engine comprising the steps of:

detecting an air-fuel ratio of air-fuel mixture supplied to the internal combustion engine;

feedback-controlling an air-fuel ratio of the mixture to a target air-fuel ratio in response to the detected air-fuel ratio;

controlling a purging of fuel evaporative gas to an intake path of the internal combustion engine in accordance with an operating condition of the internal combustion engine; and correcting the target air fuel ratio to a value on a fuel rich side during the purging of the fuel evaporative gas than during non-purging of the fuel evaporative gas;

wherein: the correcting step further corrects the target air-fuel ratio in accordance with of an actual air-fuel ratio on a downstream side of a catalyst provided in an exhaust system of the internal combustion engine.

* * * * *